United States Patent [19]

Lardellier

[11] Patent Number: 4,548,546

[45] Date of Patent: Oct. 22, 1985

[54] ADJUSTMENT SYSTEM OF CENTERING A TURBOMACHINE WHEEL AND MOUNTED TURBOMACHINE BY WAY OF PERMITTING THE APPLICATION OF SAID SYSTEM

[75] Inventor: Alain M. J. Lardellier, Melun, France

[73] Assignee: S.N.E.C.M.A., Paris, France

[21] Appl. No.: 439,212

[22] Filed: Nov. 4, 1982

[30] Foreign Application Priority Data

Nov. 5, 1981 [FR] France ..... 81 20719

[51] Int. Cl.[4] ..... F04D 29/04

[52] U.S. Cl. ..... 415/133; 33/543; 415/118; 384/447; 384/448; 384/583

[58] Field of Search ..... 33/172 D, 174 Q, 169 C, 33/181 R, 180 AT, 181 AT; 308/183; 415/133, 118, 171; 73/593, 480; 384/255, 447, 448, 583

[56] References Cited

U.S. PATENT DOCUMENTS

| | | | |
|---|---|---|---|
| 1,972,840 | 9/1934 | Graf | 384/255 |
| 2,170,493 | 8/1939 | Clapper | 33/181 AT |
| 2,554,171 | 5/1951 | Brunot et al. | 33/125 R |
| 2,616,184 | 11/1952 | Mendro et al. | 33/181 AT |
| 2,700,224 | 1/1955 | Johnson . | |
| 2,711,935 | 6/1955 | Miles | 384/255 |
| 2,812,588 | 11/1957 | Verrant | 33/174 Q |
| 2,860,015 | 11/1958 | Matterson | 384/255 |
| 2,986,086 | 5/1961 | Siebke | 384/255 |
| 3,040,436 | 6/1962 | Eisele | 33/174 Q |
| 3,177,725 | 4/1965 | Johnson | 73/480 |
| 3,315,366 | 4/1967 | Marshall | 33/174 Q |
| 3,618,219 | 11/1971 | Kelly | 33/174 Q |
| 3,888,134 | 6/1975 | Miranda | 384/255 |
| 4,035,044 | 7/1977 | Miyazaki | 308/183 |
| 4,338,726 | 7/1982 | Swailes | 33/174 Q |
| 4,395,827 | 8/1983 | Stowe et al. | 33/181 R |

FOREIGN PATENT DOCUMENTS

| | | | |
|---|---|---|---|
| 538744 | 11/1931 | Fed. Rep. of Germany | 33/181 |
| 1475358 | 4/1966 | France . | |
| 2434269 | 6/1979 | France . | |
| 316499 | 8/1929 | United Kingdom | 384/255 |
| 344669 | 3/1931 | United Kingdom . | |
| 825265 | 12/1959 | United Kingdom . | |
| 0582420 | 11/1977 | U.S.S.R. | 384/255 |

OTHER PUBLICATIONS

Machinery and Production Engineering, 1969, vol. 115, No. 2963, "Portable Comparator for Checking Engineering Components", pp. 347–350.

*Primary Examiner*—Samuel Scott
*Assistant Examiner*—B. J. Bowman
*Attorney, Agent, or Firm*—Oblon, Fisher, Spivak, McClelland & Maier

[57] ABSTRACT

An adjustment system for centering a turbojet wheel, and a turbojet equipped with a mechanism enabling the system to be applied and, more particularly, an adjustment system for centering a turbojet wheel in the stator ring that encircles it. The system includes, for purposes of determining the degree and direction of any possible off-centering of the wheel and ring and allowing the off-centering to be easily compensated for by a removable device for measuring the degree and direction of off-centering of the wheel with respect to the ring, and a mechanism connected to the fixed bearing closest to the wheel for bringing the value of off-centering back within preset limits.

2 Claims, 6 Drawing Figures

ADJUSTMENT SYSTEM OF CENTERING A TURBOMACHINE WHEEL AND MOUNTED TURBOMACHINE BY WAY OF PERMITTING THE APPLICATION OF SAID SYSTEM

BACKGROUND OF THE INVENTION

1. Field of the Invention

The invention relates to turbojets and, more particularly, to an adjustment system for centering a turbojet wheel within the stator ring that encircles it wherein the invention is particularly advantageous when said wheel forms part of the high pressure stage of a turbine in a turbojet engine, a stage in which the narrow centering tolerances of the wheel are particularly critical and wherein the invention also concerns a turbojet equipped with means enabling said adjustment system to be applied.

2. Description of the Prior Art

The most common known solution for performing the above centering operation consists of the following steps: creating a finishing allowance when machining the inner cylindrical bearing of the turbine frame, the inside of which will be housed a fixed journal bearing supporting the shaft and lying closest to the wheel; dry-run mounting of at least that portion of the stator frame that includes the bearing and the ring; measuring the relative eccentricity of the bearing and ring; and finishing machining of the bearing so as to bring this eccentricity within tolerance limits.

This solution is reliable but has the disadvantage of requiring the dry-run mounting. This drawback is particularly inconvenient when the turbine is of modular design, i.e., when the HP (high pressure) stage is made completely independently of the MP (middle pressure) or LP (low pressure) stage to which it must be joined without alteration.

In French Pat. No. 2,434,269 it has already been proposed that annular bearings set off-center with respect to the axis of the jet be provided on the intermediate rings that join the portion of the turbine frame that includes the stator ring to the portion that includes the fixed bearing support. The shaft is therefore centered at the time the two portions of frame are assembled by giving these intermediate rings set orientations calculated from the results of measurements of the relative eccentricity of the stator ring and the bearing surface. This solution makes it necessary to make these intemediate ring bearings with different degrees of off-centering in order to obtain compensation for the off-centering of the shaft through vector addition of the off-centering of the intermediate rings. The solution becomes practically inapplicable when the diameters of the rings are large.

SUMMARY OF THE INVENTION

The purpose of the invention is to provide an adjustment system having none of the disadvantages mentioned above, and one that will at the same time make possible easy adjustment of the centering of a wheel in an already mounted turbine.

The system of the invention, intended therefore to make it possible to adjust the centering of a turbojet wheel with respect to the stator ring that encircles it, with said wheel being borne on a shaft turning within fixed bearings inserted in seats connected to the turbine frame, is characterized in that it comprises the following elements: a removable device for measuring the degree and direction of the wheel's off-centering with respect to the ring, and means attached to the fixed bearing lying closest to the wheel for bringing the value of the wheel's off-centering back within a preset limit.

It will be seen that the construction of the removable measuring device differs depending on whether one is adjusting the centering during assembly of the parts of the turbine or instead rectifying an existing off-centering in an already mounted turbine.

The means attached to the fixed bearing and used for reducing the degree of off-centering advantageously comprise an annular compensator ring inserted between the shaft and the fixed bearing and preferentially between the fixed bearing and its seat. The inner and outer bearing surfaces of this ring are off-centered by a value equal to the measured off-centeredness, thereby compensating precisely for the latter by means of a suitable orientation of the compensator ring.

According to the preceding general definition of the invention, it can be seen that the shaft in question need not be the one that directly supports the wheel, though it is this one that is involved when the shaft is turning within fixed journal bearings, i.e., bearings connected directly to the frame. But if the turbine is a twin body jet in which the shaft of the wheel to be centered (HP wheel) is supported by an intershaft bearing that is itself supported by a shaft turning within fixed bearings (MP or LP wheel shaft), the means for reducing the degree of off-centering are connected to the fixed bearing closest to this wheel. The recentering of the latter is thus carried out through the LP or MP shaft and through the HP shaft. It will be seen that this arrangement considerably facilitates the mounting of the compensator ring.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENTS

Figure 1:
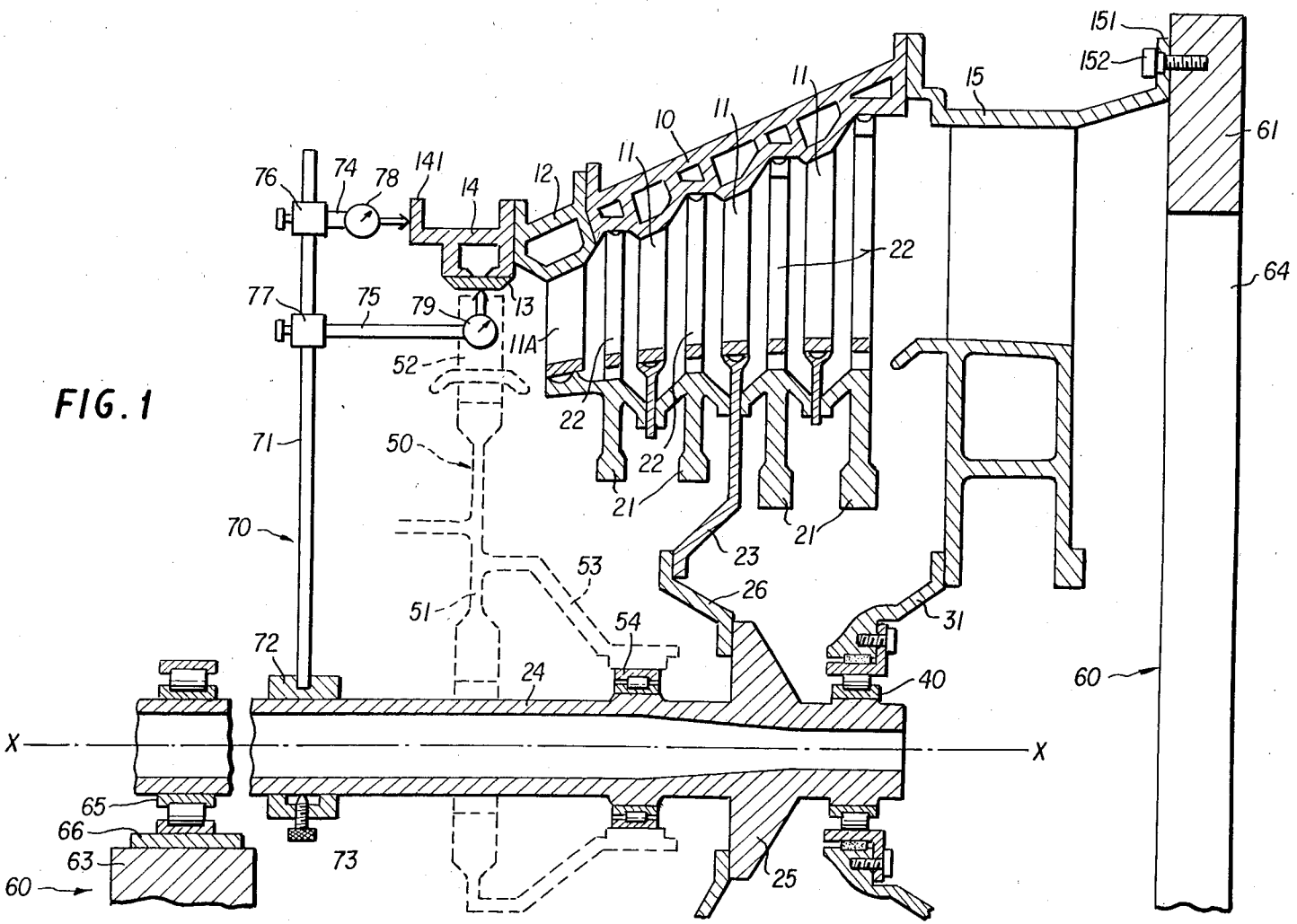
FIG. 1 represents an upper, axial half-sectional view of a twin-body turbine mounted on the device for measuring the eccentricity of the HP wheel, to be used in accordance with the present invention during assembly of the parts of the turbine.

FIG. 1 will be considered first. In principle, this figure shows only the mechanical components useful for understanding the invention. Numerous elements such as gaskets, assembly flanges, etc. have not been represented.

The LP (low pressure) stator comprises housing 10 carrying successive rings of fixed blades 11 and a ring 12 fastened to the upper or upstream flange of housing 10, and, more particularly, carrying the first ring of fixed flanges 11A that constitutes the intake distributor of the LP module. Onto the upper flange of ring 12 is attached that portion of the HP (high pressure) stator that includes stator ring 13, delimiting the HP stream, as well as collar 14 fixed to the upper flange of ring 12 and stator ring 13. Lastly, housing 10 is fastened by its lower flange to the upper flange of turbine frame element 15.

The LP rotor comprises the following elements: LP wheels including disks 21, each of which carries a ring of mobile blades 22; the disk support, which comprises outer flank 23, supporting disks 21, and inner flank 26, to which the central part of flank 23 is fastened; and shaft 24, the lower end of which rests in the fixed bearing 40 seated in the bore of conical support 31 whose periphery is affixed to frame element 15, and which is equpped with a collar 25 to which the central part of flank 26 is fastened.

The high pressure turbine wheel 50 comprises the following elements: disk 51 carrying a ring 52 of mobile blades; conic shaft 53 integral with disk 51 downstream from the latter and supported by LP shaft 24 through intershaft bearing 54; and hollow shaft 55 integral with disk 51, placed upstream of the latter and encircling shaft 24. Only the downstream end of hollow shaft 55 is represented. It will be remembered that this shaft 55 drives the HP compressor upstream.

The elements making up the high pressure wheel 50 are sketched in broken lines since measuring device 70 (discussed below) is necessarily used before this rotor is mounted.

Figure 2:
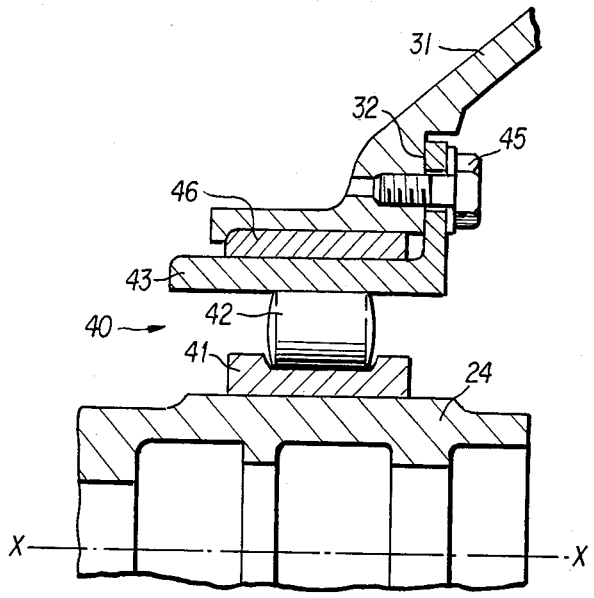
FIG. 2 represents in larger scale an upper, axial half-sectional view of the lower or downstream fixed bearing of the LP turbine shaft, said bearing being constructed in accordance with the invention.

FIG. 2 will now be considered. This Figure shows the way in which fixed bearing 40 is mounted within bearing support 31 in accordance with the invention in order to make it possible to adjust the position of shaft 24 within this support. The bearing is a roller bearing comprising inner ring 41 mounted on shaft 24, roller 42, and outer ring 43 seated within the bore of support 31. Ring 43 is equipped with a collar 44 that allows it to be fastened to a flat bearing surface 32 on support 31 by means of bolt 45.

Figure 3:
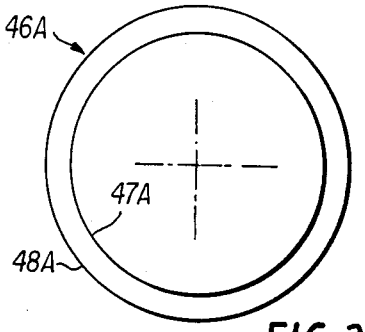
FIG. 3 represents in intermediate scale a test ring inserted around this fixed bearing and forming part of the measuring device.
Figure 4:
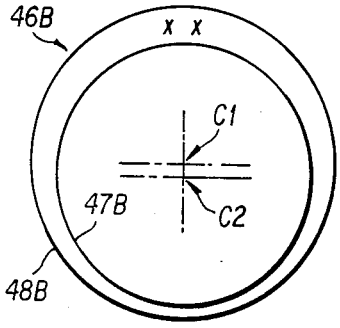
FIG. 4 represents in the same intermediate scale the compensator ring intended to replace the test ring.

As per the invention, ring 43 is centered within the bore of support 31 by means of an interchangeable ring 46. In the course of taking measurements of eccentricity, this ring 46 comprises a ring 46A (FIG. 3) with concentric cylindrical bearings 47A and 48A. For recentering of shaft 24 within support 31 in accordance with the information furnished by the measuring device described below, ring 46 comprises an eccentric ring 46B (FIG. 4) whose cylindrical bearings 47B and 48B are off-centered by a suitable value (the distance of their respective centers C2 and C1).

In order to faciliate its correct placement, ring 46B has two benchmarks on one face, an XX indicating the direction of the greatest eccentricity and an X diametrically opposite thereto, indicating the direction of the least eccentricity. The orientation of eccentric ring 46B is maintained by tightening this eccentric ring in the axial direction against collar 44 by means of bolts 45. This positioning may also be achieved by means of the banding between the contact surface of ring 46B and the facing part of support 31.

Figure 5:
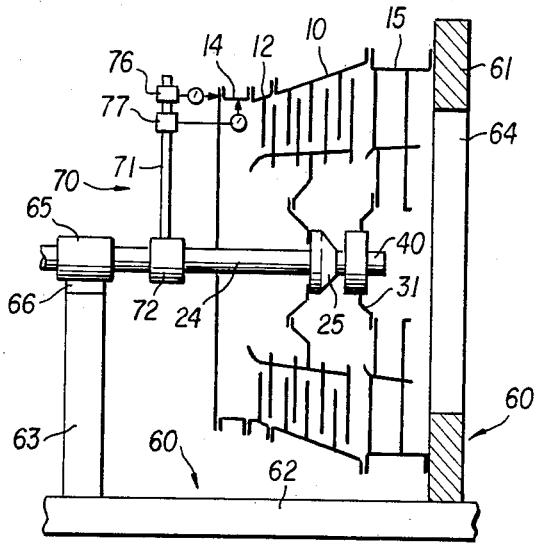
FIG. 5 is a schematic sectional view of the entire eccentricity-measuring device.

The measuring device and its method of use will now be described, with reference to FIGS. 1 and 5. This measuring device comprises a measuring frame 60 and a measuring arm of measuring device 70. Frame 60 is a square whose vertical leg 61 is designed to grip frame 15 of the turbine by the latters lower flange, while horizontal leg 62 supports leg 61 and a shaft support 63. A large-sized hole 64 is provided in leg 61 to permit access through the downstream end of bearing 40.

The frame of the turbine (frame element 15, housing 10–12, collar 14) is first fastened to vertical leg 61 by means of bolts 152 passing through lower flange 151 of frame element 15. Shaft 24 is then mounted within conical support 31 (accessible through opening 4 in the measuring frame 60) through bearing 40 and concentric-bearing ring 46A (shown in FIG. 3), while simultaneously being supported at the upstream end by means of a bearing 65 affixed to support 63. The position of bearing 65 is adjustable at will in both directions transverse to the axis of the turbine, e.g., by means of transverse stops (not shown) and blocks such as blocks 66.

Onto shaft 24 is mounted an arm 70 for measuring eccentricity that includes (i) a radial shank-support 71 affixed at its base to a coupling 72 screwed onto the shaft by a screw 73, and (ii) two arm-supports parallel to the axis of shaft 24 and fastened to sheaves 76 and 77 that can slide along shank 71 and be fastened there in set positions.

The first phase of measurement consists of (i) setting on outer arm 74 a movement sensor or comparator 78 whose contact piece moves over the downstream flat surface of flange 141 of collar 14, and (ii) turning shaft 24 and setting the position of bearing 65 such that the movements of the contact piece remain under a set limit (e.g., 20 to 30 microns). One is then certain that axis X—X of shaft 24 is perpendicular to the plane of flange 141 and consequently parallel to the axis of the LP stator.

The second phase consists of using a comparator 79 borne by inner arm 75 to move over the inner wall of ring 13 by causing shaft 24 to turn. A reading of the information provided by this comparator then makes it possible to determine the eccentricity of shaft and ring and, consequently, to determine the C1–C2 eccentricity and the position in which ring 46B (FIG. 4) must be placed in order to correct this eccentricity. Ring 46B is either created as needed or chosen from amongst a batch of rings whose degrees of eccentricity are distributed over a set range.

A check is made by again truing, if need be, the position of shaft 24 by means of comparator 78 and bearing 65 and by taking another measurement of eccentricity using comparator 79. If the results fall within the tolerances, measuring device 70 can be dismantled and assembly of the turbine resumed.

In the embodiment of the invention just described, the recentering of shaft 24 in the bore of support 31 (FIG. 2) is done by means of intermediate ring 46 inserted between said bore and outer ring 43 of bearing 40.

The example just described involves a twin-body turbine in which conical HP shaft 53 is mounted on LP shaft 24 by means of an intershaft bearing 54. As already pointed out, the invention can be applied without difficulty to cases in which the HP turbine shaft is supported by bearings in a stationary part. Recentering is then done using an eccentric ring inserted around the downstream fixed bearing.

Figure 6:
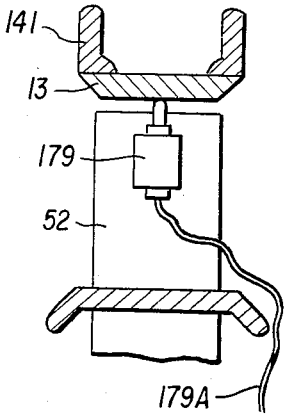
FIG. 6 illustrates an alternate embodiment of the measuring device.

FIG. 6 will now be considered. This Figure shows the measuring device used in accordance with the invention to true the centering of an HP wheel in an assembled turbine. This involves the turbine already shown in FIGS. 1–5. This measuring device comprises an electric comparator 179 attached to one of the mobile blades 52 of the HP wheel and placed in such a way as to move over the inner wall of ring 13. To mount the comparator, one has only to detach flange 141. Information from the comparator is transmitted over a flexible cable 179A wound up behind HP disk 51 (FIG. 1) and issuing (for example) from an endoscopic inspection orifice (not shown) provided in the frame. Measurements are taken with the engine closed up again. The centering of the HP wheel may be trued if necessary by changing ring 46 (FIG. 2), accessible from the side of frame element 15. Comparator 179 may then be withdrawn through the inspection orifice.

Obviously, numerous modifications and variations of the present invention are possible in light of the above teachings, it is therefore to be understood that within the scope of the appended claims, the invention may be practiced otherwise than as specifically described herein.

I claim:

1. A turbojet comprising:

a shaft mounted on a plurality of fixed bearings inserted within seats joined to a turbine frame;

at least one high-pressure turbine wheel mounted on said shaft;

a stator ring that surrounds said wheel, wherein said turbine frame further comprises at an upstream end thereof a collar having an assembly flange wherein said stator ring is positioned on said collar;

a support assembly operatively associated with a first fixed bearing of said plurality of fixed bearings which is located downstream closest to said wheel and having a seat; and a single eccentric ring mounted on said shaft and having relatively off-centered inner and outer bearing surfaces and which is positioned between said first fixed bearing of said plurality of fixed bearings, located downstream closest to said high pressure wheel and in contact with said inner bearing surface, and said support assembly of said fixed bearing located downstream closest to said high pressure wheel, said support assembly being in contact with said outer bearing surface wherein an outer bearing ring of said first fixed bearing is fixedly attached to said support assembly so as to fix the position of said single eccentric ring.

2. A turbojet comprising:

a turbine frame having a plurality of fixed bearings integral therewith;

a first shaft mounted on said fixed bearings;

an intershaft bearing supported by said first shaft;

a second shaft integral with said intershaft bearing;

a high pressure turbine wheel mounted on said second shaft;

a stator ring that surrounds said wheel, wherein said turbine frame further comprises at an upstream end thereof a collar having an assembly flange wherein said stator ring is positioned on said collar;

a support operatively associated with a first fixed bearing of said fixed bearings which is downstream closest to said high-pressure wheel and having a fixed bearing seat; and a single eccentric ring mounted on said first shaft and having relatively off-centered inner and outer bearing surfaces, said ring being positioned between said first fixed bearing, located downstream closest to the high pressure wheel and in contact with said inner bearing surface, wherein said fixed bearing seat provided in said support of said fixed bearing surface and said support is in contact with said outer bearing and wherein an outer bearing ring of said first fixed bearing is fixedly attached to said support assembly so as to fix the position of said single eccentric ring.

* * * * *